US011773670B2

(12) United States Patent
Gao et al.

(10) Patent No.: US 11,773,670 B2
(45) Date of Patent: Oct. 3, 2023

(54) CONTROL MECHANISM OF CORE DRILLING RIG

(71) Applicants: SHENZHEN UNIVERSITY, Guangdong (CN); SICHUAN UNIVERSITY, Sichuan (CN)

(72) Inventors: Mingzhong Gao, Sichuan (CN); Heping Xie, Sichuan (CN); Ling Chen, Sichuan (CN); Jun Guo, Sichuan (CN); Zhilong Zhang, Sichuan (CN); Zetian Zhang, Sichuan (CN); Ru Zhang, Sichuan (CN); Yiqiang Lu, Sichuan (CN); Cong Li, Sichuan (CN); Zhiqiang He, Sichuan (CN)

(73) Assignees: SHENZHEN UNIVERSITY, Guangdong (CN); SICHUAN UNIVERSITY, Sichuan (CN)

( * ) Notice: Subject to any disclaimer, the term of this patent is extended or adjusted under 35 U.S.C. 154(b) by 253 days.

(21) Appl. No.: 17/309,233

(22) PCT Filed: Nov. 12, 2018

(86) PCT No.: PCT/CN2018/114965
§ 371 (c)(1),
(2) Date: Mar. 11, 2022

(87) PCT Pub. No.: WO2020/093413
PCT Pub. Date: May 14, 2020

(65) Prior Publication Data

US 2022/0213747 A1 Jul. 7, 2022

(30) Foreign Application Priority Data

Nov. 8, 2018 (CN) ..... 201811327652.0

(51) Int. Cl.
*E21B 23/04* (2006.01)
*E21B 21/10* (2006.01)
(Continued)

(52) U.S. Cl.
CPC ..... *E21B 23/04115* (2020.05); *E21B 21/10* (2013.01); *E21B 25/10* (2013.01); *E21B 34/063* (2013.01)

(58) Field of Classification Search
CPC ..... E21B 17/043; E21B 21/00; E21B 21/10; E21B 25/00; E21B 25/10; E21B 23/04115; E21B 34/063
See application file for complete search history.

(56) References Cited

U.S. PATENT DOCUMENTS 2,381,844 A * 8/1945 Stokes ..... E21B 25/00 175/254
4,580,643 A * 4/1986 Fox ..... E21B 25/00 175/239
(Continued)

FOREIGN PATENT DOCUMENTS

CN 102418488 A 4/2012
CN 204630763 U 9/2015
(Continued)

*Primary Examiner* — Caroline N Butcher
*Assistant Examiner* — Nicholas D Wlodarski
(74) *Attorney, Agent, or Firm* — NKL Law; Allen Xue

(57) ABSTRACT

A control mechanism of a core drilling rig includes a central rod (14) and an outer barrel (23). The central rod (14) passes through, from the rear to the front, the inner cavities of a fluid channel activation module, an outer barrel unlocking module, a flow diverging module, and a coring barrel connecting module. The coring barrel connecting module comprises a core tube connecting pipe (62), a core ring bearing (63), a bearing inner ring (64), a ball A (6211) and a ball B (6411). The core tube connecting pipe (62) is connected at the front side thereof to the coring barrel (65).
(Continued)

The bearing inner ring (64) is inside the core tube connecting pipe (62). The core ring bearing (63) is connected to an inner wall of the outer barrel (23).

10 Claims, 9 Drawing Sheets

(51) Int. Cl.
*E21B 25/10* (2006.01)
*E21B 34/06* (2006.01)

(56) References Cited

U.S. PATENT DOCUMENTS 4,834,198 A * 5/1989 Thompson ..... E21B 23/08
175/244
11,131,147 B1 * 9/2021 Berger ..... E21B 10/02

FOREIGN PATENT DOCUMENTS

CN 205689152 U 11/2016
WO 2018104818 A1 6/2018

* cited by examiner

CONTROL MECHANISM OF CORE DRILLING RIG

TECHNICAL FIELD

The present invention relates to a core drilling system, and especially to a control mechanism of core drilling rig.

BACKGROUND ART

In the process of oilfield exploration, rock core is the key material for discovering oil and gas reservoir, as well as studying stratum, source rock, reservoir rock, cap rock, structure, and so on. Through the observation and study of the core, the lithology, physical properties, as well as the occurrence and characteristics of oil, gas, and water can be directly understood. After the oilfield is put into development, it is necessary to further study and understand the reservoir sedimentary characteristics, reservoir physical properties, pore structure, wettability, relative permeability, lithofacies characteristics, reservoir physical simulation, and reservoir water flooding law through core. Understanding and mastering the water flooded characteristics of reservoirs in different development stages and water cut stages, and finding out the distribution of remaining oil can provide scientific basis for the design of oilfield development plan, formation system, well pattern adjustment, and infill well.

Coring is to use special coring tools to take underground rocks to the ground in the process of drilling, and this kind of rock is called core. Through it, various properties of rocks can be determined, underground structure and sedimentary environment can be studied intuitively, and fluid properties can be understood, etc. In the process of mineral exploration and development, the drilling work can be carried out according to the geological design of strata and depth, and coring tools were put into the well, to drill out rock samples.

The downhole temperature is high, and electrical equipment cannot be used. Mechanical structures are required to control the various steps of the drilling rig equipment.

CONTENT OF THE INVENTION

The invention is intended to provide a control mechanism of core drilling rig, which can cooperate with ground equipment to control the downhole equipment of the core drilling rig to work according to the coring procedures.

In order to realize the above objectives, the technical solutions adopted by the present invention are as follows:

The control mechanism of core drilling rig, disclosed in the present invention, comprises a central rod, a fluid channel activation module, an outer barrel, an outer barrel unlocking module, a flow diverging module, and a coring barrel connecting module. The central rod passes through, from the rear to the front, the inner cavities of a fluid channel activation module, an outer barrel unlocking module, a flow diverging module, and a coring barrel connecting module. The fluid channel activation module is behind the outer barrel, and the fluid channel activation module is connected to the outer barrel unlocking module;

The coring barrel connecting module comprises a core tube connecting pipe, a core ring bearing, a bearing inner ring, and the central rod passes through the core tube connecting pipe, the core ring bearing and the bearing inner ring. The core tube connecting pipe is connected at the front side thereof to the coring barrel. The bearing inner ring is inside the core tube connecting pipe. The core ring bearing is connected to the inner wall of the outer barrel, and the inner diameter of the core ring bearing is longer than the outer diameter of the core tube connecting tube and the coring barrel. A ball slot A is formed on the inner wall of the core ring bearing. The core tube connecting pipe is provided with a ball hole A and a ball slot B, and the ball slot B is on the inner wall of the core tube connecting pipe. The ball hole A is in front of ball groove B. The bearing inner ring is provided with a ball hole B and a ball slot C, and the ball slot C is on the outer wall of the bearing inner ring. The ball hole B is behind the ball groove C. Ball hole A has ball A, and ball hole B has ball B. The diameter of the ball B is greater than the depth of the ball hole B. The outer wall of the central rod has a ball groove D and an inner ring stop step from back to front. The outer diameter of the inner ring stop step is longer than the inner diameter of the bearing inner ring, while the outer diameter of the inner ring stop step is shorter than the inner diameter of the core tube connecting pipe. The distance between the inner ring stop step and the ball groove D is equal to the distance between the front end of the bearing inner ring and the ball hole B. When drilling, the ball A is in the ball hole A and the ball groove A, while the ball B is in the ball hole B and the ball groove B. The core tube connecting pipe is connected to the core ring bearing through the ball A, and the core tube connecting tube is connected to the bearing inner ring through the ball B. When pulling, the ball A is in the ball hole A and the ball groove C, while the ball B is in the ball hole B and the ball groove D. The core tube connecting pipe is connected to the bearing inner ring through the ball A, and the bearing inner ring is connected to the central rod through the ball B.

Further, said fluid channel activation module comprises a lock body, a locking rod, and a start shear pin. The locking rod is in the lock body, and the locking rod and the lock body are connected by the start shear pin. Said central rod is in the locking rod. The lock body comprises a sealing section A, and the locking rod comprises a sealing section B. The sealing section A and the sealing section B are in a sealing fit, while said sealing section B is in a sealing fit with the central rod. Further, there is a fluid channel A between the central rod and the locking rod, and the locking rod has an outflow hole A, that communicates with a connecting fluid channel A. The outflow hole A is behind the sealing section B. There is a fluid channel B between the lock body and the locking rod, and the fluid channel B is in front of the sealing section A. Before starting the shear pin to cut, the outlet of the outflow hole A is at the sealing section A, and the front end of the fluid channel A is sealed. After starting the shear pin to cut, the locking rod moves forward, the outlet of the outflow hole A is located in front of the sealing section A, and the fluid channel A and the fluid channel B are connected through the outflow hole A.

Further, said outer barrel unlocking module comprises the connecting pipe and the lock pin. The rear end of the connecting pipe is connected to the lock body, while the rear end of the lock pin is connected to the locking rod. The central rod passes through the inner cavity of the lock pin, and the lock pin is in the connecting pipe. The outer diameter of the front section of the connecting pipe is shorter than the inner diameter of the outer barrel, and the side wall of the front section of the connecting pipe has an unlocking hole. There is a groove A on the outer wall of the lock pin, while there is a groove B on the inner wall of the outer barrel. The pin is also included, the length of the pin is greater than the depth of the unlocking hole, and the pin is arranged in the unlocking hole. Further, the outer end of the pin is chamfered and/or the side surface of the groove B is inclined. The width of groove A is not less than the width of the inner end of the pin, while the width of the groove B is not less than the width of the outer end of the pin. The front end of the connecting pipe is in the outer barrel, and the pin is in front of the groove A. The inner end surface of the pin is in sliding fit with the outer wall of the lock pin, and the outer end of the pin is embedded in the groove B. After the shear pin is started to cut, the locking rod drives the lock pin forward, the unlocking hole is directly opposite to the groove A, the inner end of the pin is embedded in the groove A, and the distance from the inner end surface of the pin to the inner wall of the outer cylinder is greater than the length of the pin.

Further, said flow diverging module includes a valve housing, a lock housing and a trigger mechanism. The central rod passes through the inner cavity of the valve housing. The valve housing is inside the lock housing. From back to front, the valve housing includes a sealing section C and a diversion section. The lock housing includes an inflow section B and an outflow section B from back to front. There is a fluid channel D between the central rod and the inflow section B, while there is a fluid channel E between the outer wall of the central rod and the inner wall of the valve housing. The back end of fluid channel D communicates with fluid channel B, and fluid channel E communicates with fluid channel D, and fluid channel E communicates with the cooling hole of the front drill bit. The inner diameter of the inflow section B is longer than the outer diameter of the sealing section C, while the outer diameter of the sealing section C is greater than the outer diameter of the diversion section, and the inner diameter of the outflow section B is equal to the outer diameter of the sealing section C. Before stopping the drilling, the front end of sealing section C is in the inflow section B, and the fluid channel D and the outflow hole B are connected. After stopping the drilling, the sealing section C and the outflow section B are in a sealing fit, and the fluid channel D is separated from the outflow hole B.

Further, said valve housing further includes a locking section A. The locking section A is connected to the front end of the diversion section. The lock housing also includes a locking section B, that is connected to the front end of the outflow section B. The inner wall of the outer barrel is connected to a safety gear. The trigger mechanism includes a locking sleeve, a fixing ring, and a safety gear. The lock housing passes through the inner cavity of the locking sleeve, and the outer wall of the locking section A is provided with a locking groove A. The locking section B has a locking hole A and a locking hole B, and the locking hole B is in front of the locking hole A. Both locking hole A and locking hole B are through holes. Locking hole A and locking hole B have the same size, and there are locking balls in both locking hole A and locking hole B. The diameter of the locking ball is greater than the depth of the locking hole A. The locking sleeve includes an impact section and the locking section C from back to front. The inner wall of the locking section C has a locking groove B and a locking groove C. The locking groove C is in the front of locking groove B. The distance between the locking groove B and the locking groove C is equal to the distance between the locking hole A and the locking hole B. The fixing ring is fixed on the outer wall of the locking section B, and the fixing ring is behind the locking hole A. The inner diameter of the impact section is longer than the outer diameter of the fixing ring. The locking section C is in front of the fixing ring. The safety gear includes the clamping part and the pressing part from back to front. The inner diameter of the front end of the pressing part is shorter than the outer diameter of the impact section, while the inner diameter of the pressing part is not less than the outer diameter of the fixing ring. The inner diameter of the front end of the clamping part is shorter than the outer diameter of the rear end of the fixing ring. There is a limit part in the central rod, and the limit part is in the locking section B and in front of the locking section A. The outer wall of the limit part is provided with a locking groove D, and the locking groove D is in front of the locking groove A. Moreover, a fluid channel F (46) is opened inside the limit part. The fluid channel E is connected to the cooling hole of the front drill bit by the fluid channel F. The axial distance from the front end of the clamping part to the front end of the pressing part is equal to the axial distance from the center of the locking hole A to the center of the locking groove B before drilling stops. Before stopping the drilling, the distance from the rear end of the sealing section C to the rear end of the outflow hole B is greater than the axial distance from the center of the locking hole A to the center of the locking groove A after stopping the drilling. After the drilling is stopped, the axial distance from the center of the locking hole A to the center of the locking groove A is greater than the distance from the front end of the sealing section C to the front end of the outflow hole B before the drilling is stopped.

Further, there is a fluid channel C between the central rod, the lock pin and the locking rod, as well as the side wall of the locking rod is provided with an inflow hole. The fluid channel B communicates with the fluid channel C through the inflow hole, while the fluid channel C communicates with the fluid channel D. The connecting pipe includes a pressure-relief section and a choke section from back to front. The lock pin and the choke section are in a sealing fit, and the inner diameter of the choke section is shorter than the inner diameter of the pressure-relief section. The pressure-relief section is provided with a pressure-relief hole, and the pressure-relief hole is a through hole. There is a shearing plunger in the fluid channel B, and the inner diameter of the shearing plunger is longer than the outer diameter of both the lock pin and the locking rod. The shearing plunger is connected to the lock body through the end shearing pin. The shearing plunger includes a shearing section and a recoil section from back to front. The outer wall of the shearing section is in a sealing fit with the inner wall of the lock body, and the outer diameter of the recoil section is equal to the inner diameter for the front part of the pressure-relief hole in the pressure-relief section. Before stopping the drilling, the front end of the recoil section is in front of the front end of the pressure-relief hole, and the recoil section is in a sealing fit with the front part of the pressure-relief hole in the pressure-relief section. After stopping the drilling, liquid backflow impacts the front end of the shearing plunger, and the shearing plunger moves backward. The front end of the recoil section is behind the front end of the pressure-relief hole, and the fluid channel B communicates with the pressure-relief hole.

Further, the outer wall of the locking rod and the inner wall of the lock body are provided with mutually matched limit steps.

Further, a lock nut is also included. The lock nut is behind the lock body, and the lock nut penetrates back and forth. The central rod passes through the inner cavity of the lock nut, and the front end of the lock nut is threadedly connected with the rear end of the lock body. The start shear pin passes through the rear end thread of the lock body.

Further, the lock nut includes a fixed section and a threaded section. The outer diameter behind the step of the locking rod is shorter than the inner diameter of the fixed section, while the inner diameter of the fixed section is shorter than the outer diameter of the step of the locking rod. The threaded section is connected to the rear end of the lock body.

Further, said lock nut is axially provided with a fixing hole A, and the fixing hole A is a through hole. The lock body has a fixing hole B on the rear face, but the fixing hole B is a blind hole. The fixing hole A and the fixing hole B are paired. Said lock nut also includes a fixing screw, and the length of the fixing screw is greater than the depth of the fixing hole. The fixing screw is in the fixing hole A, and the front end of the fixing screw is inserted into the fixing hole B through the fixing hole A.

The present invention has the following beneficial effects:

1. Before starting, the start shear pin fixes the locking rod on the lock body, the outflow hole A is in the sealing section A, the outer wall opening of the outflow hole A is sealed, the fluid channel is blocked, the connecting pipe is connected to the lock body, and the outer end of the pin is inserted into the groove B, to lock the outer barrel on the connecting pipe. When the hydraulic pressure provided by the mud pump at the rear reaches the starting value, the start shear pin is broken, the locking rod moves forward, the fluid passes through the fluid channel A and enters the fluid channel B through the outflow hole A, and then flows into the fluid channel C through the inflow hole, followed by flowing through the flow diverging module. A part of the fluid passes through the fluid channel D, the fluid channel E, and the fluid channel F, and then reaches the cooling hole of the drill bit, to cool the drill bit. A part of the fluid passes through the fluid channel D and communicates with the front hydraulic motor through the outflow hole B. The hydraulic motor is started, and the locking rod moves forward to drive the lock pin forward, so that the groove A and the unlocking hole are directly opposite, and the outer barrel moves forwards due to the gravity itself. The contact surface between the groove B and the outer end of the pin is inclined, and the pin is squeezed into the groove A, to release the constraint of the outer barrel. The front end of the outer barrel is connected to working parts such as the hydraulic motor rotor and the drill bit, to move the drill bit forward;
2. Before stopping the drilling, the locking ball is in the locking hole A and the locking groove A, to lock the valve housing and keep the fluid channel D in communication with the front hydraulic motor through the outflow hole B. When the outer barrel moves forward to the stop position, the outer barrel drives the safety gear to hit the locking sleeve, to move the locking sleeve forward. The locking groove B is directly opposite to the locking hole A, and the radial restraint of the locking ball is released. The fluid impacts the rear end of the valve housing, the locking ball is squeezed into the locking groove B, and the valve housing moves forward. The sealing section C separates the fluid channel D from the outflow hole B, that stops supplying energy to the front motor, and the motor is off. Because the fluid channel D is blocked, the liquid flows backwards and runs back to the fluid channel B. The recoil shears the front end of the plunger, the shearing plunger receives the backward force, and thus the shearing plunger moves backward. The front end of the recoil section moves to behind the pressure-relief hole, the fluid channel B communicates with the outside through the pressure-relief hole, and the liquid is discharged from the pressure-relief hole;
3. When drilling, the ball A is in the ball hole A and the ball groove A, while the ball B is in the ball hole B and the ball groove B. The core tube connecting pipe is connected to the core ring bearing through the ball A, and the core tube connecting pipe is connected to the bearing inner ring through the ball B. The core ring bearing is connected to the outer barrel, and the front end of the core tube connecting pipe is connected to the coring barrel, so that the core tube connecting pipe, the bearing inner ring, and the coring barrel can move forward with the outer barrel and the drill bit. However, the core tube connecting pipe, the bearing inner ring and the coring barrel do not rotate with the outer barrel and the drill bit, and the ball A and the ball B can reduce friction;
4. When lifting, the ball hole A and the ball groove C are directly opposite, while the ball groove D and the ball hole B are directly opposite. The ball A is in the ball hole A and the ball groove C, while the ball B is in the ball hole B and the ball groove D. The core tube connecting pipe is connected to the bearing inner ring through the ball A, and the bearing inner ring is connected to the central rod through the ball B. The front end of the core tube connecting pipe is connected to the coring barrel. The central rod is lifted by the ground machinery to take the coring barrel out of the well and recover the cores collected;
5. A lock nut is set, that is threadedly connected to the lock body, and the connecting section is threadedly connected to the outflow section A, which is convenient for installation and replacement of the start shear pin;
6. The fixing hole, the fixing hole B and the fixing screw cooperate to restrict the circumferential rotation.

Figure 1:
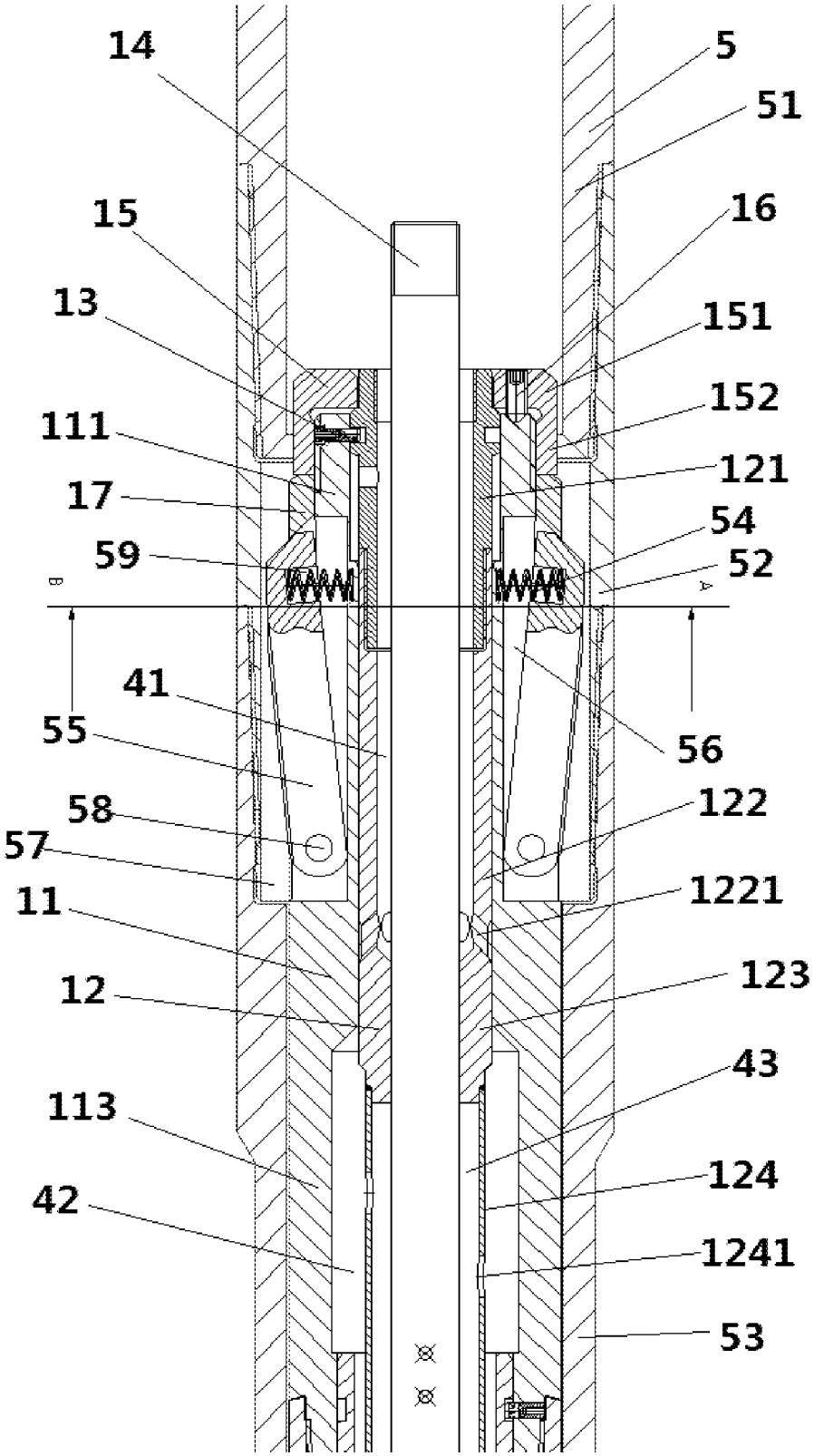
FIG. 1. Schematic diagram for interlocking of dental drill and core drilling rig.
Figure 2:
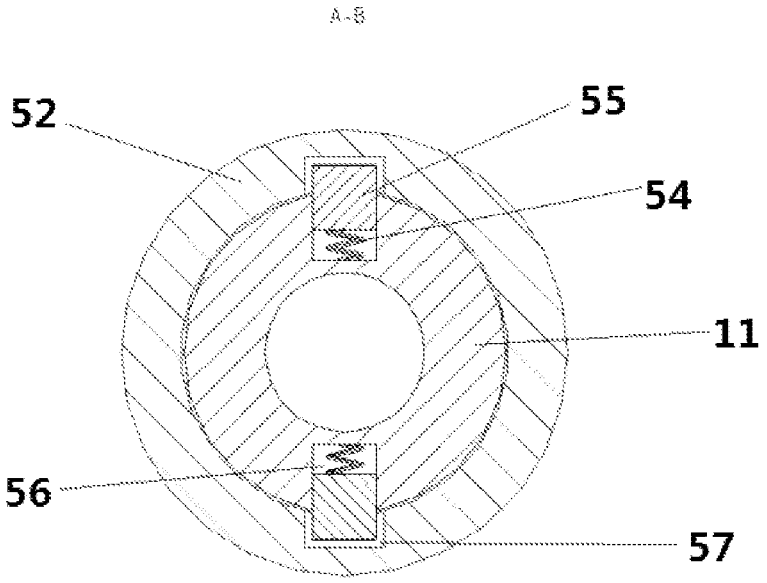
FIG. 2. A-B cross-sectional view.
Figure 3:
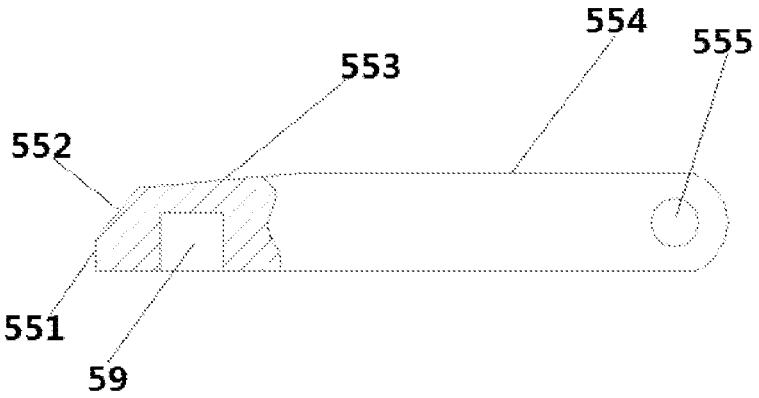
FIG. 3. Schematic diagram of the latch.
Figure 4:
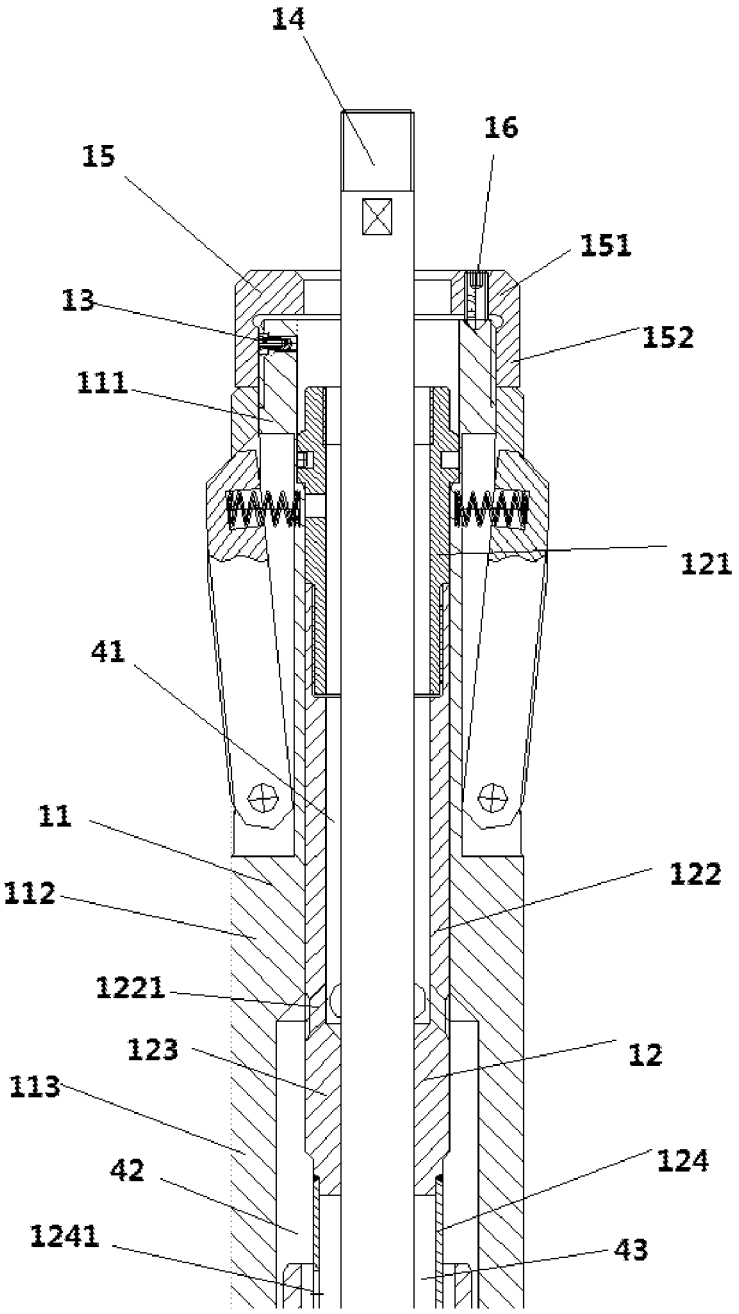
FIG. 4. Schematic diagram of the fluid channel activation module after starting.

In Figures: 11—lock body, 111—locking section, 112—sealing section A, 113—liquid channel section, 12—locking rod, 121—connecting section, 122—outflow section A, 1221—outflow hole A, 123—sealing section B, 124—Inflow section A, 1241—inflow hole, 13—start shear pin, 14—central rod, 15—lock nut, 151—fixed section, 152—threaded section, 16—fixing screw, 17—sealing stell ring, 21—connecting pipe, 211—connecting section, 212—pressure relief section, 2121—pressure relief hole, 213—choke section, 22—lock pin, 221—groove A, 23—outer barrel, 231—groove B, 232—Safety gear, 2321—clamping part, 2322—pressing part, 24—pin, 25—end shearing pin, 26—shearing plunger, 261—shearing section, 262—recoil section, 31—valve housing, 311—sealing section C, 312—diversion section, 313—locking section A, 3131—locking groove A, 32—lock housing, 321—inflow section B, 322—outflow section B, 3221—outflow hole B, 323—locking section B, 3231—locking hole A, 3232—locking hole B, 33—locking sleeve, 331—impact section, 332—locking section C, 3321—locking groove B, 3322—locking groove C, 34—locking ball, 35—fixing ring, 36—limit part, 361—locking groove D, 37—snap ring, 41—fluid channel A, 42—fluid channel B, 43-fluid channel C, 44—fluid channel D, 45—fluid channel E, 46—fluid channel F, 5—dental drill, 51—the first drill tube, 52—the second drill tube, 53—the third drill tube, 54—spring, 55—latch, 551—the rear face of the latch, 552—the first slope of the latch, 553—the second slope of the latch, 554—the axial face of the latch, 555—latch hole, 56—latch slot, 57—lock slot, 58—pin shaft, 59—spring hole, 61—core tube stop head, 62—core tube connecting pipe, 621—ball hole A, 6211—ball A, 622—ball slot B, 63—core ring bearing, 631—ball slot A, 64—bearing inner ring, 641—ball hole B, 6411—ball B 642—ball slot C, 65—coring barrel, 661—ball slot D, 662—inner ring stop step, 663—connecting pipe stop step.

EXAMPLES

In order to make the objectives, technical solutions, and advantages of the present invention clearer, the present invention will be further illustrated hereinafter by combing with the attached Figures.

As shown in FIGS. 1~4, the control mechanism of core drilling rig disclosed in the present invention includes a dental drill 5 and a core drill. The dental drill 5 is hollow, the core drill is in the dental drill 5, and the outer wall of the core drill is in a sliding fit with the inner wall of the dental drill 5. The dental drill 5 comprises a first drill tube 51, a second drill tube 52, and a third drill tube 53 from back to front. The first drill tube 51 and the second drill tube 52 are detachably connected, and the second drill tube 52 and the third drill tube 53 are detachably connected. The front end of the first drill tube 51 is a male end, and the rear end of the second drill tube 52 is a female end, but the front end is a male end. The rear end of the third drill tube 53 is a female end. The inner wall of the second drill tube 52 is provided with a locking groove 57, that is arranged along the axial direction. The locking groove 57 penetrates the front and rear ends of the second drill tube 52. There are two locking grooves 57, and both of them are opposite.

The outer wall of the core drill is provided with latch grooves 56. Moreover, there are two latch grooves 56, and they are opposite. The latch grooves 56 are arranged along the axial direction. There is a latch 55 in the latch groove 56. Both of two side walls of the latch groove 56 are connected by a pin shaft 58, and the pin shaft 58 is a positioning pin. The latch 55 has a latch hole 555. The latch hole 555 is a through hole, and is adapted to the pin shaft 58. The pin shaft 58 passes through the latch hole 555, and the latch 55 is rotatingly fit with the pin shaft 58. The distance from the latch hole 555 to the rear end of the latch 55 is greater than the distance from the latch hole 555 to the front end of the latch 55. The inner side of the latch 55 has a spring hole 59. The spring hole 59 is a round and blind hole. The distance between the spring hole 59 and the rear end of the latch 55 is less than the distance between the spring hole 59 and the front end of the latch 55. The bottom of the latch groove 56 has a recess corresponding to the spring hole 59. The spring 54 is installed in the spring hole 59 and the recess, and is in contact with the outer wall of the core drill and the latch 55. When the spring 54 bounces up, the latch 55 is partially embedded in the locking groove 57.

The outer side of the latch 55 includes an axial surface 554, a first inclined surface 552, and a second inclined surface 553. The rear end of the first inclined surface 552 of the latch is connected to the rear end surface 551 of the latch, and the front end of the first inclined surface 552 of the latch is connected to the rear end of the second inclined surface 553 of the latch, while the front end of the second inclined surface 553 of the latch is connected to the rear end of the latch axial surface 554. The front end of the latch axial surface 554 is connected to the front end surface of the latch. The rear end surface 551 of the latch is a flat surface, while the front end surface of the latch is a curved surface. The spring hole 59 and the recess are within the projection range of the second inclined surface 553 of the latch to the inner surface of the latch 55. The distances from the center of the latch hole 555 to the inner side and the outer side of the latch 55 are equal, and the total length of the latch 55 is 131 mm. The distance from the connection of the latch axial surface 554 and the second inclined surface 553 of the latch to the rear end surface 551 of the latch is 42 mm. The angle between the first inclined surface 552 of the latch and the radial section is 40°, while the angle of the second inclined surface 553 of the latch and the radial section is 85°. The arc surface radius of the front end surface of the latch is 11 mm, while the diameter of the latch hole 555 is 10 mm. The arc center of the front end surface of the latch coincides with the center of the latch hole 555. The diameter of the spring hole 59 is 13 mm, and the depth is 12 mm. The distance from the center of the spring hole 59 to the rear end surface 551 of the latch is 20 mm, and the width and thickness of the latch 55 are both 20 mm.

The core drill moves from back to front. When the locking groove 57 and the latch groove 56 are directly opposite, the latch 55 bounces up to engage the core drill with the dental drill 5. The left and right side walls of the latch 55 are matched with the locking groove 57, that restricts the circumferential movement of the core drilling rig. The axial face 554 of the latch is inclined, and clamped with the inner wall of the rear end of the third drill tube 53, to restrict the core drilling rig from moving forward.

The core drilling rig includes a central rod 14, a fluid channel activation module, an outer barrel 23, an outer barrel unlocking module, a flow diverging module, and a core barrel connection module.

The central rod 14 passes from back to front through the inner cavity of the fluid channel activation module, the outer barrel unlocking module, a flow diverging module, and a core barrel connection module. The liquid channel activation module is behind the outer barrel 23, and connected to the outer barrel unlocking module.

Figure 5:
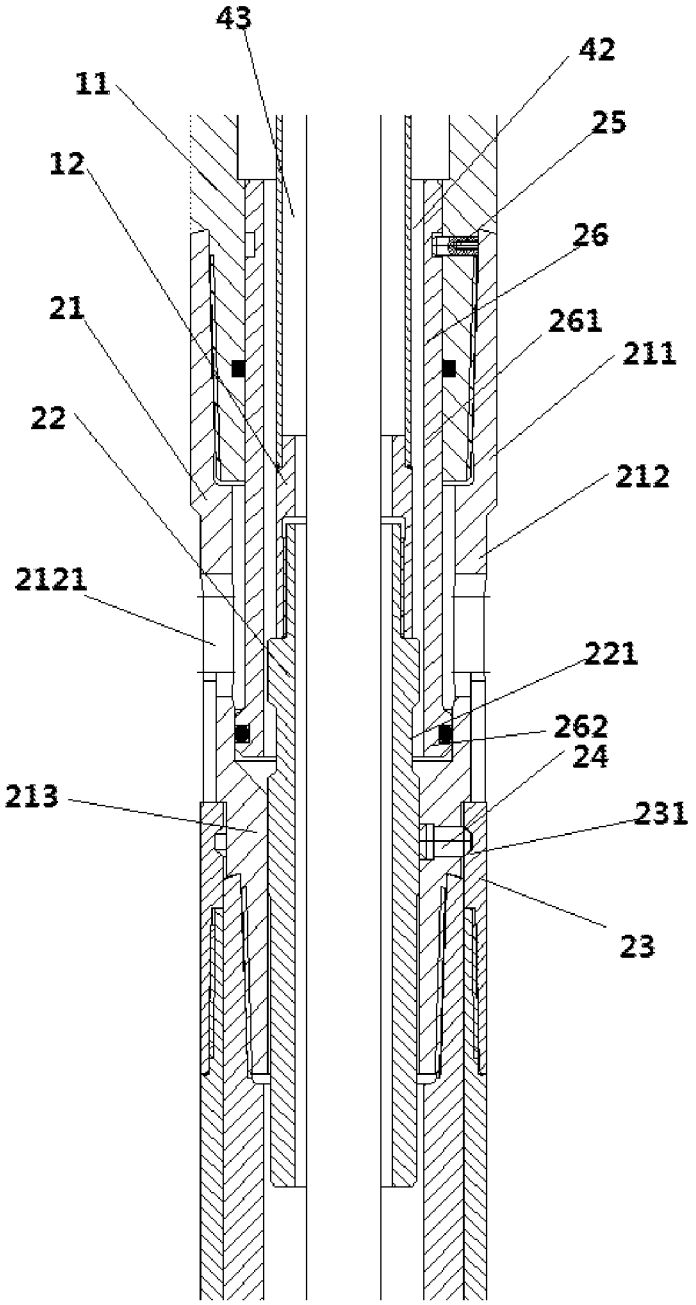
FIG. 5. Schematic diagram of the outer barrel unlocking module before starting.
Figure 6:
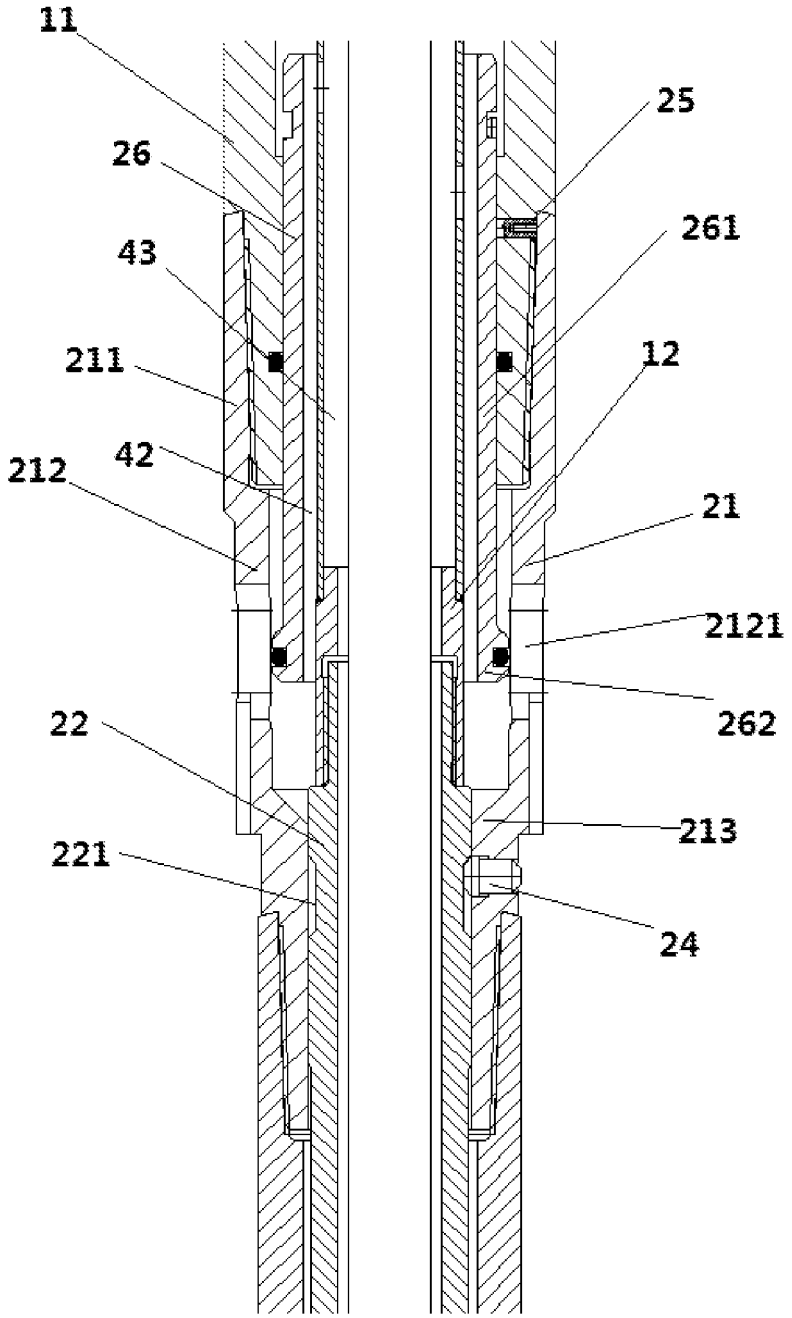
FIG. 6. Schematic diagram of the outer barrel unlocking module after stopping the drilling.

The fluid channel activation module includes a lock body 11, a locking rod 12, a start shear pin 13, and a central rod 14. The lock body 11 penetrates back and forth, the latch groove 56 is on the outer wall of the lock body 11. For the lock body 11, the outer diameter of the part behind the latch groove 56 is shorter than that of the part in front of the latch groove 56. The lock body 11 consists sequentially of a locking section 111, a sealing section A112, and a fluid channel section 113 from back to front. The side wall of the locking section 111 has a start shear pin hole, that is a through hole. The length of the start shear pin 13 is greater than its depth. The locking rod 12 penetrates back and forth, and the locking rod 12 is inside the lock body 11. The locking rod 12 includes a connecting section 121, an outflow section A122, a sealing section B123 and an inflow section A124 from back to front. The connecting section 121 is threadedly connected with the outflow section A122. The sealing section B123 and the inflow section A124 are welded. The outer wall of the connecting section 121 has a start shear pin groove, that is an annular groove. The start shear pin 13 is in the start shear pin hole and the start shear pin groove. The side wall of the outflow section A122 is provided with an outflow hole A1221, and the side wall of the inflow section A124 is provided with an inflow hole 1241. The outflow hole A1221 is inclined forward from the inside to the outside. There are multiple outflow holes A1221, and these holes are evenly distributed along the circumference at the same axial position. There are multiple inflow holes 1241. The inflow holes 1241 are distributed in front and back on different sides. The inner diameter of the locking section 111 is longer than that of the sealing section A112. The outer wall of the connecting section 121 has a step. whose outer diameter is longer than the inner diameter of the sealing section A112. The outer diameter in front of the step of the connecting section 121 is equal to the inner diameter of the sealing section A112. The start shear pin groove is on the outer wall of the step. The central rod 14 is in the locking rod 12. The sealing section A112 and the sealing section B123 are in a sealing fit. The inner diameter of the fluid channel section 113 is longer than the outer diameter of the locking rod 12. The inner diameter of the connecting section 121, the outflow section A122 and the inflow section A124 is greater than the outer diameter of the central rod 14, and the sealing section B123 is in a sealing fit with the central rod 14. The axial distance from the front end of the sealing section A112 to the rear end of the lock body 11 is less than the axial distance from the front end of the sealing section B123 to the rear end of the lock body 11. The start shear pin 13 penetrates the start shear pin hole and is inserted into the start shear pin groove. The axial distance from the open in the outer wall of the outflow hole A1221 to the rear end of the lock body 11 is shorter than the axial distance from the rear end of the fluid channel section 113 to the rear end of the lock body 11. A lock nut 15 and a sealing steel ring 17 are also comprised. The sealing steel ring 17 is connected to the lock body 11, and the sealing steel ring 17 is connected behind the latch groove 56. The outer diameter of the sealing steel ring 17 is same as that of the lock body 11 part in front of the latch groove 56. The inner wall of the rear section of the sealing steel ring 17 is in contact with the outer wall of the lock body 11, and the inner diameter of the rear section of the sealing steel ring 17 is shorter than the outer diameter of the lock body 11 in the front of it. The inner diameter of the front section of the sealing steel ring 17 gradually increases from back to front. The angle between the inner wall of the front section of the sealing steel ring 17 and the radial section is 45°. The front end surface of the sealing steel ring 17 is in the front of the rear end surface of the latch groove 56 and behind the second inclined surface 553 of the latch. The inner diameter of the sealing steel ring 17 at the rear end surface of the latch groove 56 is longer than the outer diameter of the lock body 11 here. The outer side surface of the latch 55 is in contact with the inner wall of the sealing steel ring 17. The outer diameter of the sealing steel ring 17 is 99.6 mm, and the inner diameter is 82 mm. The length of the sealing steel ring 17 is 23 mm, and the outer wall of the rear end of the sealing steel ring 17 has a 3 mm×45° chamfer. The outer diameter of the lock body 11 part behind the latch groove 56 is 82 mm. The lock nut 15 is behind the sealing steel ring 17. The lock nut 15 presses the sealing steel ring 17 tightly, and penetrates back and forth. The central rod 14 passes through the inner cavity of the lock nut 15. The front end of the lock nut 15 is threadedly connected with the rear end of the lock body 11. The start shear pin hole is opened at the thread of the rear end of the lock body 11. The radial distance from the inner wall of the lock nut 15 to the bottom of the start shear pin groove is not less than the length of the start shear pin. The lock nut 15 includes a fixing section 151 and a thread section 152. The outer diameter of the connecting section 121 part behind the step is shorter than the inner diameter of the fixing section 151, as well as shorter than the outer diameter of the step. The inner diameter of the thread section 152 is equal to the outer diameter of the locking section 111. The lock nut 15 has a fixing hole A in the axial direction, that is a through hole. The rear face of the lock body 11 has a fixing hole B, that is a blind hole. The fixing hole A is matched with the fixing hole B. A fixing screw 16 is also comprised. The length of the fixing screw 16 is greater than the depth of the fixing hole A. The fixing screw 16 is in the fixing hole A. The front end of the fixing screw 16 is inserted into the fixing hole B through the fixing hole A. After the fluid is provided, the locking rod 12 moves forward, and the start shear pin 13 is cut. The start shear pin head is in the start shear pin hole, while the start shear pin tail is in the start shear pin groove. The start shear pin head includes a big end and a small end, and the big end faces outside. In addition, the outer diameter of the big end is greater than that of the small end. The start shear pin hole includes an outer section and an inner section. The diameter of the outer section is not less than the outer diameter of the big end of the start shear pin, while the diameter of the inner section is not less than the outer diameter of the small end of the start shear pin. The diameter of the inner section is shorter than the outer diameter of the big end, and the depth of the outer section is not less than the length of the big end. The sum of the length of the small end and that of the start shear pin tail is greater than the depth of the inner section;

As shown in FIGS. 5 and 6, the outer barrel unlocking module comprises a connecting pipe 21 and a lock pin 22. The rear end of the connecting pipe 21 is threadedly connected to the lock body 11. The rear end of the lock pin 22 is threadedly connected to the locking rod 12. The central rod 14 passes through the inner cavity of the lock pin 22, and the outer diameter of the central rod 14 is shorter than the inner diameter of the lock pin 22. The central rod 14, the connecting pipe 21, the outer barrel 23, and the lock pin 22 are coaxial. The lock pin 22 is in the connecting pipe 21. The outer diameter of the front section of the connecting pipe 21 is shorter than the inner diameter of the outer barrel 23. The side wall of the front section of the connecting pipe 21 has unlocking holes. There are multiple unlocking holes, and these unlocking holes are evenly distributed along the circumference at the same axial position. The lock pin 22 has a groove A221 on the outer wall. The inner wall of the outer barrel 23 has a groove B231. The groove A221 and the groove B231 are both annular grooves. A pin 24 is also comprised. The length of the pin 24 is greater than the depth of the unlocking hole. The pin 24 is in the unlocking hole, and its outer end is chamfered. The side of the groove B231 is a bevel. The angle between the outer chamfer of the pin 24 and the radial section is complementary to the angle between the side of groove B231 and the radial section. The width of the groove A221 is not less than the width of the inner end of the pin 24. The width of the groove B231 is not less than the width of the outer end of the pin 24. The pin 24 includes the pin head and the pin body, and the pin head is on the inside. The unlocking hole is divided into the pin head section and the pin body section, and the pin head section is on the inside. The inner diameter of the pin head section is not less than the outer diameter of the pin head, while the inner diameter of the pin body section is not less than the outer diameter of the pin body. The length of the pin head is less than the depth of the pin head section, but the length of the pin body is greater than the depth of the pin body section. After activation, the inner end of the pin 24 is embedded in the groove A221. The distance from the inner end surface of the pin 24 to the inner wall of the outer barrel 23 is greater than the length of the pin 24.

The connecting pipe 21 comprises a connecting section 211, a pressure relief section 212, and a choke section 213 from back to front. The outer diameter of the lock pin 22 is equal to the inner diameter of the choke section 213. The inner diameter of the choke section 213 is shorter than the inner diameter of the pressure relief section 212. There is a pressure relief hole 2121 in the pressure relief section 212, that is a through hole. The inner wall of the lock body 11 is provided with an end shear pin hole radially, and there is an end shear pin 25 in the end shear pin hole. The length of the end shear pin 25 is greater than the depth of the end shear pin hole. A shear plunger 26 is also comprised. The inner diameter of the shear plunger 26 is longer than the outer diameter of the lock pin 22 and the locking rod 12. The shear plunger 26 comprises a shear section 261 and a recoil section 262 from back to front. The outer wall of the shear section 261 is in a sealing fit with the inner wall of the lock body 11. The inner wall of the lock body 11 is provided with a sealing groove B, and there is a sealing ring in the sealing groove B. The sealing groove B is in front of the end shear pin hole. The outer diameter of the recoil section 262 is equal to the inner diameter of the pressure relief section 212 in the front of the pressure relief hole 2121. A sealing groove A is opened on the outer wall of the recoil section 262. A sealing ring is arranged in the sealing groove A. An end shear pin groove is opened on the outer wall of the shear section 261, while a diversion groove is opened on the outer wall of the connecting pipe 21. The diversion groove is right in front of the pressure relief hole 2121. The diversion groove is arranged axially, and connected with the pressure relief hole 2121. Before stopping the drilling, the front end of the recoil section 262 is in front of the front end of the pressure relief hole 2121. The recoil section 262 and the pressure relief section 212 in front of the pressure relief hole 2121 are in a sealing fit. The inner end of the end shear pin 25 is embedded in the end shear pin groove. After stopping the drilling, the front end of the recoil section 262 is behind the front end of the pressure relief hole 2121, and the shear pin 25 is cut off.

Figure 7:
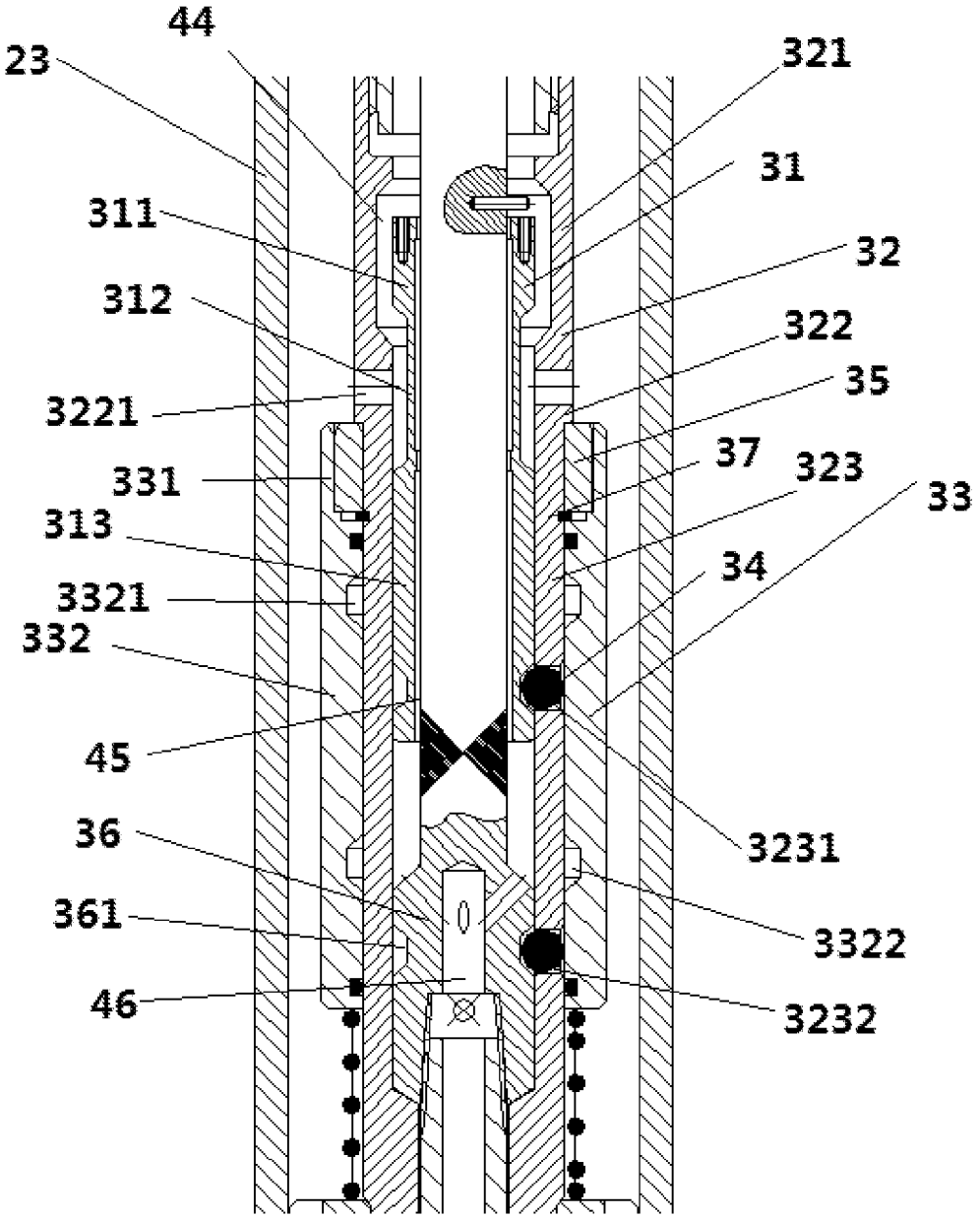
FIG. 7. Schematic diagram of the flow diverging module before stopping the drilling.
Figure 8:
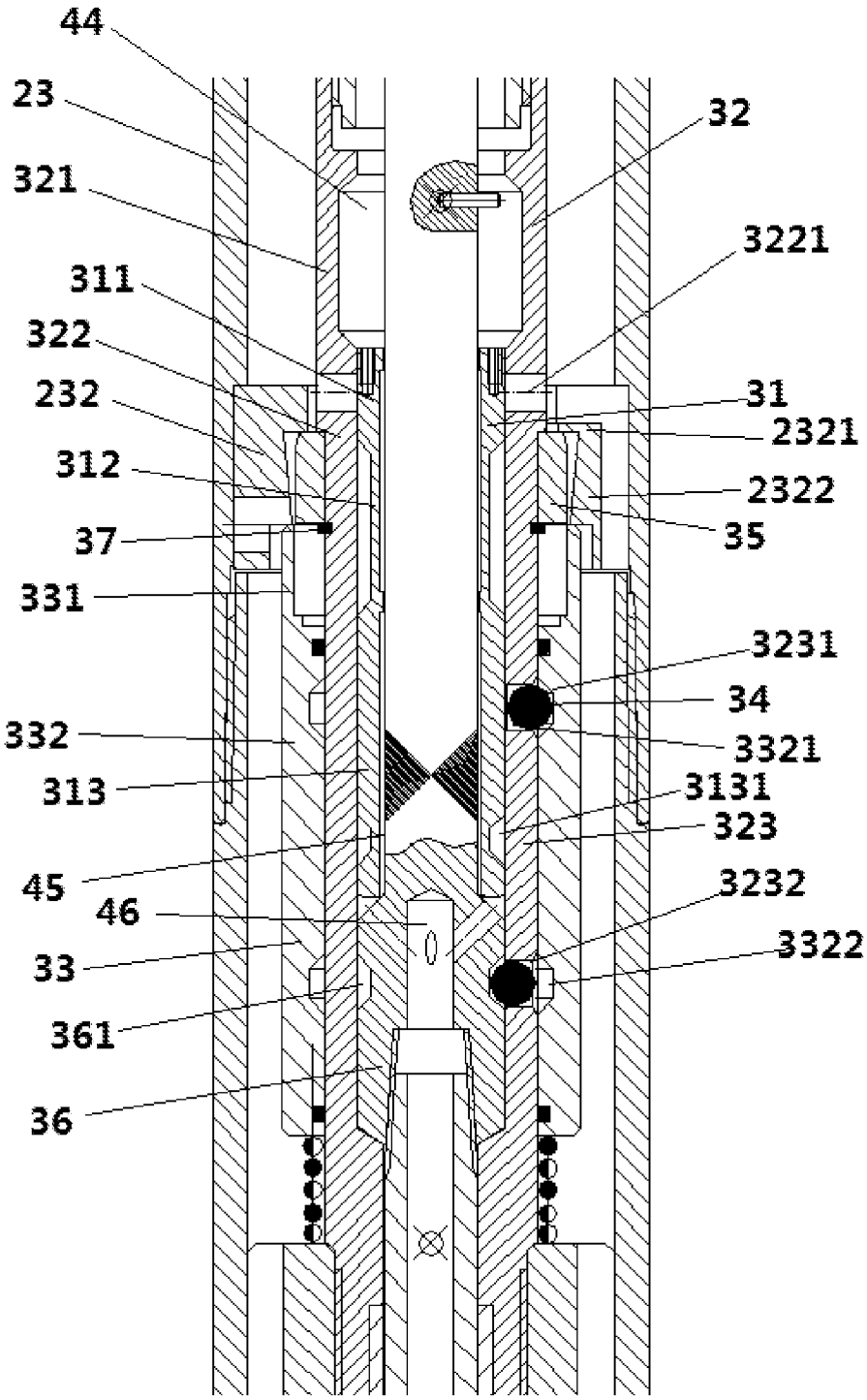
FIG. 8. Schematic diagram of the flow diverging module after stopping the drilling.

As shown in FIGS. 7 and 8, the flow diverging module includes a valve housing 31, a lock housing 32, a locking sleeve 33, and a fixing ring 35. The central rod 14, the valve housing 31, the lock housing 32, the locking sleeve 33, the fixing ring 35, and the outer barrel 23 are coaxial. The central rod 14 passes through the inner cavity of the valve housing 31, and the valve housing 31 is inside the lock housing 32. The lock housing 32 passes through the inner cavity of the locking sleeve 33, The valve housing 31 includes a sealing section C311, a diversion section 312, and a locking section A313 from back to the front. The outer wall of the locking section A313 has a locking groove A3131, that is an annular groove. The lock housing 32 includes an inflow section B321, an outflow section B322, and a locking section B323 from back to front. The inner diameter of the inflow section B322 is longer than the outer diameter of the sealing section C311, while the outer diameter of the sealing section C311 is longer than the outer diameter of the diversion section 312. The inner diameter of the outflow section B322 is equal to the outer diameter of the sealing section C311. The outflow section B322 has an outflow hole B3221. The locking section B323 has a locking hole A3231 and a locking hole B3232. The locking hole B3232 is in front of the locking hole A3231. The outflow hole B3221, the locking hole A3231, and the locking hole B3232 are all through holes with the same size. There are locking balls 34 in the locking hole A3231 and the locking hole B3232. The diameter of the locking ball 34 is greater than the depth of the locking hole A3231. The locking sleeve 33 includes an impact section 331 and a locking section C332 from back to the front. The inner wall of the locking section C332 has a locking groove B3321 and a locking groove C3322, and the grooves are both annular with the same size. The locking groove C3322 is in front of the locking groove B3321. The distance between the locking groove B3321 and the locking groove C3322 is equal to the distance between the locking hole A3231 and the locking hole B3232. The distance between the bottom of the locking groove A3131 and the inner wall of the locking section B323 is less than the diameter of the locking ball 34. The distance from the bottom of the groove A3232 to the outer wall of the locking section B323 is not less than the diameter of the locking ball 34. The distance from the bottom of the locking groove B3321 and the locking groove C3322 to the outer wall of the locking section B323 is less than the diameter of the locking ball 34. The distance from the bottom of the locking groove B3321 and the locking groove C3322 to the inner wall of the locking section B323 is not less than the diameter of the locking ball 34. The fixing ring 35 is fixed on the outer wall of the locking section B323, and the fixing ring 35 is behind the locking hole A3231. The inner diameter of the impact section 331 is longer than the outer diameter of the fixing ring 35. The locking section C332 is in front of the fixing ring 35. The inner diameter of the outer barrel 23 is longer than the outer diameters of the lock housing 32 and the locking sleeve 33. The inner wall of the outer barrel 23 is connected to a safety gear 232. The safety gear 232 includes a clamping part 2321 and a pressing part 2322 from back to the front. The inner diameter of the front end face of the pressing part 2322 is shorter than the outer diameter of the impact section 331. The inner diameter of the pressing part 2322 is not less than the outer diameter of the fixing ring 35. The inner diameter of the front end face of the clamping part 2321 is shorter than the outer diameter of the rear end face of the fixing ring 35. The central rod 14 has a limiting portion 36, that is located in the locking section B323. The limiting portion 36 is in front of the locking section A313. The outer wall of the limiting portion 36 is provided with a locking groove D361, that is an annular groove. The locking groove D361 is in front of the locking groove A3131. The gap between the outer wall of the limiting portion 36 and the inner wall of the lock housing 32 is shorter than the thickness of the front end of the locking section A313. The axial distance from the front end face of the clamping part 2321 to the front end of the pressing part 2322 is equal to the axial distance from the center of the locking hole A3231 to the center of the locking groove B3321 before stopping the drilling. Before stopping the drilling, the distance from the rear end of the sealing section C311 to the outflow hole B3221 is greater than the axial distance from the center of the lock hole A3231 to the center of the lock groove A3131. After stopping the drilling, the axial distance from the center of the locking hole A3231 to the center of the locking groove A3131 is greater than the distance from the front end of the sealing section C311 to the front end of the outflow hole B3221 before stopping the drilling. The lock housing 32 and the valve housing 31 are locked or released from the restraint by the locking ball 34 in the locking hole A3231. The lock housing 32 and the locking sleeve 33 are locked or released from the restraint through the locking ball 34 in the locking hole A3231. The lock housing 32 and the central rod 14 are locked or unconstrained by the locking ball 34 in the locking hole B3232. A snap ring 37 is also comprised, whose outer diameter is longer than the inner diameter of the fixing ring 35, and whose inner diameter is shorter than the inner diameter of the fixing ring 35. The snap ring 37 is inserted into the groove of the outer wall of the locking section B323. The fixing ring 35 is clamped between the rear end of the snap ring 37 and the front end of the outflow section B322. The front end of the locking section C332 is supported by a spring. Before stopping the drilling, the lock housing 32 and the valve housing 31 are tightly locked to keep the fluid channel unobstructed. A safety gear 232 is arranged in the outer barrel 23. When the outer barrel 23 moves forward to a limiting position, the outer barrel 23 drives the safety gear 232 to hit the locking sleeve 33, causing the locking ball 34 in the locking hole A3231 to move outward, and releasing the restraint on the valve housing 31. The valve housing 31 moves forward to close the fluid channel. The drilling is stopped. At this time, the locking groove D361, the locking hole B3232, and the locking groove C3322 are directly facing each other, and the locking ball 34 in the locking hole B3232 moves outwards, and the restriction on the central rod 14 is released.

The inner wall of the connecting section 121, the inner wall of the outflow section A122, the rear end face of the sealing section B123, and the outer wall of the central rod 14 enclose a fluid channel A41. The inner wall of the lock body 11 and the outer wall of the locking rod 12 enclose a fluid channel B42. The fluid channel C43 is surrounded by the inner wall of the locking rod 12 and the outer wall of the central rod 14. The inner wall of the lock pin 22 and the outer wall of the central rod 14 enclose a fluid channel D44. There is a fluid channel E45 between the outer wall of the central rod 14 and the inner wall of the valve housing 31, and a fluid channel F46 is opened in the limiting portion 36. The fluid channel B42 and the fluid channel C43 are connected through the inflow hole 1241; the fluid channel C43 is connected with the fluid channel D44; the back of the fluid channel E45 is connected with the fluid channel D44; the front of the fluid channel E45 is connected with the fluid channel F46; and the back of the fluid channel A41 is connected with the fluid supply equipment. The front of the outflow hole B3221 is connected to the hydraulic motor, and the fluid channel F46 is connected to the cooling hole of the drill bit in front of it.

Figure 9:
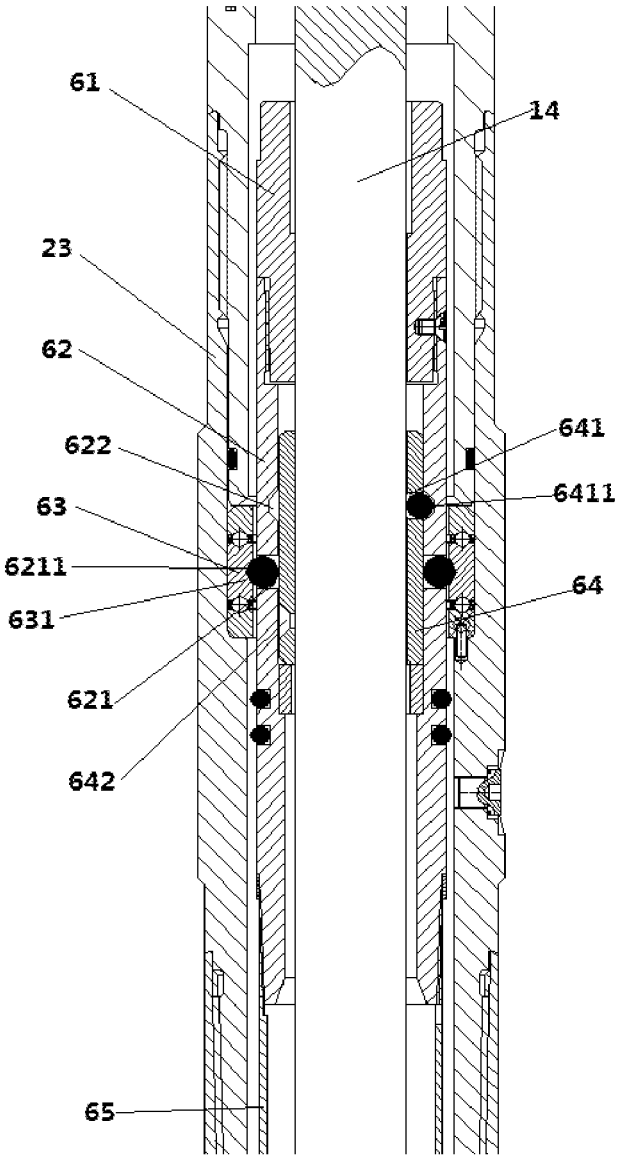
FIG. 9. Schematic diagram of the coring barrel connecting module during drilling.
Figure 10:
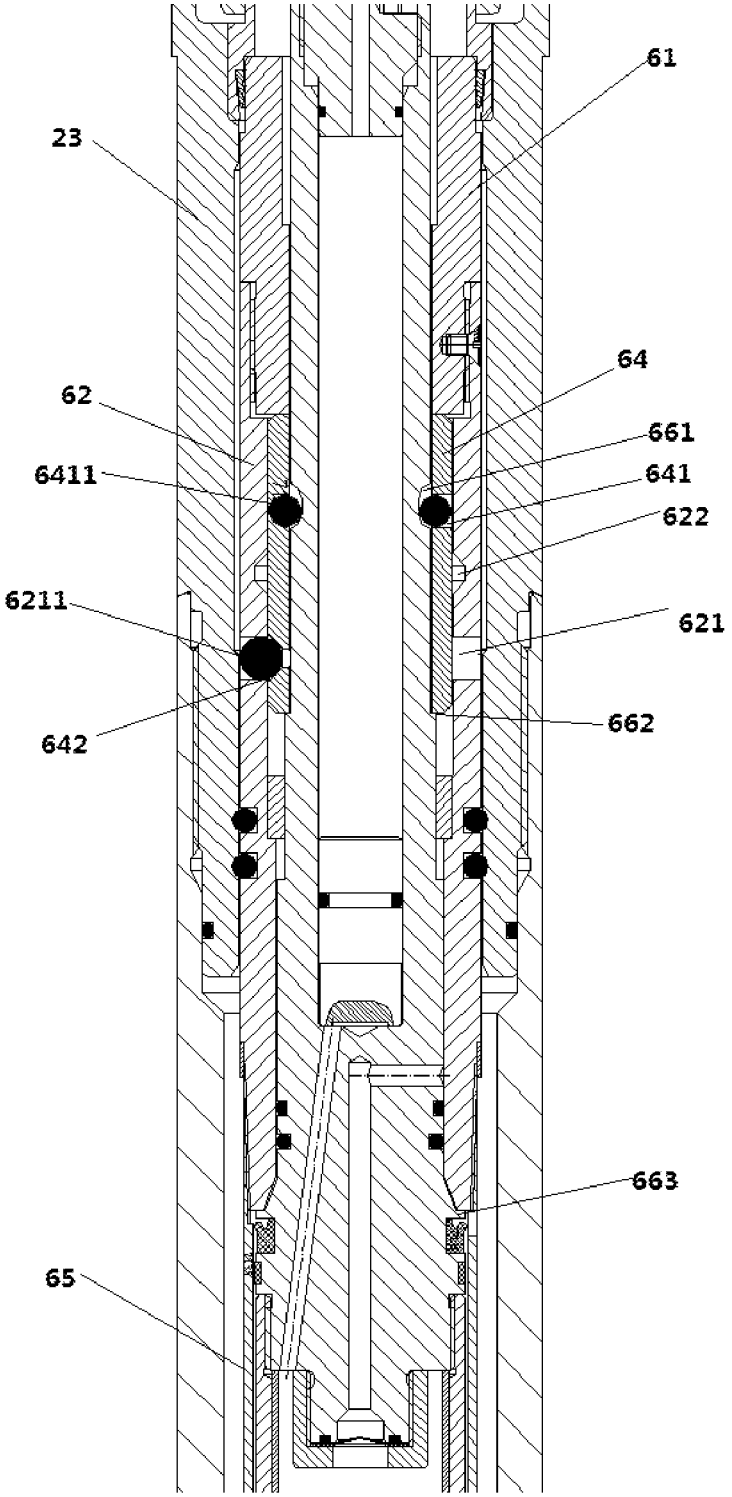
FIG. 10. Schematic diagram of the coring barrel connecting module during lifting.

As shown in FIGS. 9 and 10, the coring barrel connecting module includes a core tube stop head 61, a core tube connecting pipe 62, a core ring bearing 63 and a bearing inner ring 64. The central rod 14 coaxially passes through the core tube stop head 61, the core tube connecting pipe 62, the core ring bearing 63, and the bearing inner ring 64. The front end of the core tube connecting pipe 62 is connected to the coring barrel 65, while the rear end of the core tube connecting pipe 62 is connected to the core tube stop head 61. The bearing inner ring 64 is in the core tube connecting pipe 62, and the bearing inner ring 64 is in front of the core tube stop head 61. The bearing inner ring 64 is at the front end of the core tube stop head 61, and in the space enclosed by the inner wall of the core tube connecting pipe 62 and the outer wall of the central rod 14. The core ring bearing 63 is connected to the inner wall of the outer barrel 23. The inner diameter of the core ring bearing 63 is greater than the outer diameters of the core tube connecting pipe 62 and the coring barrel 65. The core ring bearing 63 has a ball groove A631 on the inner wall. The core tube connecting pipe 62 has a ball hole A621 and a ball groove B622. The ball groove B622 is on the inner wall of the core tube connecting pipe 62, and the ball hole A621 is in front of the ball groove B622. The bearing inner ring 64 has a ball hole B641 and a ball groove C642. The ball groove C642 is on the outer wall of the bearing inner ring 64. The ball hole B641 is behind the ball groove C642. There is a ball A6211 in the ball hole A621, whose diameter is greater than the depth of the ball hole A621. There is a ball B6411 in the ball hole B641, whose diameter is greater than the depth of the ball hole B641. The outer wall of the central rod 14 successively has a ball groove D661, an inner ring stop step 662, and a connecting pipe stop step 663 from back to front. The outer diameter of the inner ring stop step 662 is greater than the inner diameter of the bearing inner ring 64, while the outer diameter of the inner ring stop step 662 is less than the inner diameter of the core tube connecting pipe 62. The outer diameter of the connecting pipe stop step 663 is longer than the inner diameter of the core tube connecting pipe 62. The outer diameter of the connecting pipe stop step 663 is shorter than the inner diameter of the coring barrel 65. The distance between the inner ring stop step 662 and the ball groove D661 is equal to the distance between the front end of the bearing inner ring 64 and the ball hole B641. When drilling, the ball A6221 is in the ball hole A621 and the ball groove A631, while the ball B6411 is in the ball hole B641 and the ball groove B622. The core tube connecting pipe 62 is connected to the core ring bearing 63 through the ball A6211, while the core tube connecting pipe 62 is connected to the bearing inner ring 64 through the ball B6411. The rear motor makes the outer barrel 23 rotate while moving forward, and the coring barrel 65 follows the outer barrel 23 to move forward, but does not rotate with the outer barrel 23. After the front end of the bearing inner ring 64 abuts the inner ring stop step 662, the bearing inner ring 64 stops moving forward. When the ball hole B641, the ball groove B622, and the ball groove D661 are aligned, the ball B6411 rolls from the ball groove B622 into the ball groove D661, and the bearing inner ring 64 and the central rod 14 are locked, but the bearing inner ring 64 and the core tube connecting pipe 62 are released from the constraint. The core tube connecting pipe 62 continues to move forward. After the front end of the core tube connecting pipe 62 abuts the connecting tube stop step 663, the core tube connecting pipe 62 stops moving forward. While the core tube connecting pipe 62 moves forward, the ball hole A621, the ball groove A631 and the ball groove C642 are directly opposite, and the ball A6211 rolls from the ball groove A631 into the ball groove C642, thus the outer barrel 23 and the core tube connecting pipe 62 are released, but the core tube connecting pipe 62 and the bearing inner ring 64 are locked. The coring barrel 65 stops moving forward. When pulling and coring, the ball A6221 is in the ball hole A621 and the ball groove C642, while the ball B6411 is in the ball hole B641 and the ball groove D661. The core tube connecting pipe 62 is connected to the bearing inner ring 64 through the ball A6211, and the bearing inner ring 64 is connected to the central rod 14 by the ball B6411. Before starting, the start shear pin 13 passes through the start shear pin hole and is inserted into the start shear pin groove. The locking rod 12 is fixed in the lock body 11 by the start shear pin 13. The axial distance from the outer wall opening of the outflow hole A1221 to the rear end of the lock body 11 is less than the axial distance from the rear end of the fluid channel section 113 to the rear end of the lock body 11. The outer wall opening of the outflow hole A1221 is closed by the sealing section A112, and the liquid cannot flow forward. The front end of the connecting pipe 21 is in the outer barrel 23, and the pin 24 is in front of the groove A221. The inner end of the pin 24 is slidingly fitted with the outer wall of the lock pin 22, while the outer end of the pin 24 is embedded in the groove B231. The outer barrel 23 is fixed outside the connecting pipe 21 by the pin 24. After the hydraulic pressure provided by the rear mud pump reaches the starting value, it impacts the rear end of the locking rod 12 to cut off the start shear pin 13, and the start shear pin 13 breaks into the start shear pin head and the start shear pin tail. The start shear pin head is in the start shear pin hole, while the starting shear pin tail is in the start shear pin groove. The locking rod 12 moves forward. The axial distance from the outer wall opening of the outflow hole A1221 to the rear end of the lock body 11 is greater than the axial distance from the rear end of the fluid channel section 113 to the rear end of the lock body 11. The fluid channel A41 and the fluid channel B42 are connected through the outflow hole A1221. Fluid channel A41, fluid channel B42, fluid channel C43, fluid channel D44, fluid channel E45, and fluid channel F46 are connected, and fluid channel D44 is connected to the hydraulic motor by outflow hole B3221. The front of the fluid channel F46 is connected to the cooling hole of the drill bit, and the hydraulic energy provided by the fluid supply equipment behind the fluid channel A41 is transmitted to the hydraulic motor and the drill bit ahead through the fluid channel A41, the fluid channel B42, the fluid channel C43, the fluid channel D44, the fluid channel E45 and the fluid channel F46, so as to drive the motor and cool the drill bit. The locking rod 12 drives the lock pin 22 to move forward. The inner end of the pin 24 is in a sliding fit with the outer wall of the lock pin 22. When the groove A221 slides forward to the same axial position as the pin 24, the outer barrel 23 generates forward pressure by its own gravity, and the contact surface of the groove B231 and the pin 22 is an inclined surface. The groove B231 presses the inclined surface of the pin 24. The pin 24 withdraws from the groove B231 and is pressed into the groove A221, to release the restraint of the outer barrel 23. The outer barrel 23 drives the front-connected working parts to move forward.

The front of the outer barrel 23 is connected to the hydraulic motor rotor and the drill bit. When the drilling rig is working, the outer barrel 23 moves from back to front. The fluid flows into the liquid channel D44 through the fluid channel A41, the fluid channel B42, and the fluid channel C43. The fluid channel D44 is connected to the front hydraulic motor through the outflow hole B3221.

Moreover, the fluid channel D44 is connected to the cooling hole of the drill bit in front through the fluid channel E45 and the fluid channel F46. The locking ball 34 in the locking groove A3131 and the locking hole A3231 restricts the valve housing 31 from moving forward. The outer barrel 23 drives the safety gear 232 to move forward. After the outer barrel 23 moves to the limit position, the safety gear 232 hits the locking sleeve 33, to make the locking groove B and the locking hole A directly face each other. The fluid in the fluid channel D44 impacts the rear end of the valve housing 31, squeezing the locking ball 34 into the locking groove B, and the valve housing 31 is released from the restraint and moves forward. The sealing section C311 moves into the outflow section B322, blocks the channel between the fluid channel D44 and the outflow hole B3221, and cuts off the fluid channel. Consequently, the motor stops rotating, the fluid flows back to the fluid channel B42, and backflushes the recoil section 262 to make it move backwards. The end shear pin 25 is cut off, and thus the fluid channel B42 and the pressure relief hole 2121 are connected, and the pressure is relieved through the pressure relief hole 2121.

Of course, there are still many other examples of the present invention. Without departing from the spirit and the essence of the present invention, those skilled in the art can make various corresponding changes and deformations according to the invention, but these corresponding changes and deformations shall belong to the protection scope of the claims of the present invention.

The invention claimed is:

1. A control mechanism of core drilling rig, comprising:

a central rod (14), a fluid channel activation module, an outer barrel (23), an outer barrel unlocking module, a flow diverging module, and a coring barrel connecting module, wherein:

the central rod (14) extends through inner cavities of the fluid channel activation module, the outer barrel unlocking module, the flow diverging module, and the coring barrel connecting module, the fluid channel activation module is disposed uphole of the outer barrel (23), and the fluid channel activation module is connected to the outer barrel unlocking module;

the coring barrel connecting module comprises a core tube connecting pipe (62), a core ring bearing (63), a bearing inner ring (64), and the central rod (14) passes through the core tube connecting pipe (62), the core ring bearing (63) and the bearing inner ring (64), the core tube connecting pipe (62) is connected at a downhole side thereof to the coring barrel (65), the bearing inner ring (64) is inside the core tube connecting pipe (62), the core ring bearing (63) is connected to an inner wall of the outer barrel (23), and an inner diameter of the core ring bearing (63) is longer than the outer diameter of the core tube connecting tube (62) and the coring barrel (65), a ball slot A (631) is formed on the inner wall of the core ring bearing (63), the core tube connecting pipe (62) is provided with a ball hole A (621) and a ball slot B (622), and the ball slot B (622) is on the inner wall of the core tube connecting pipe (62), the bearing inner ring (64) is provided with a ball hole B (641) and a ball slot C (642), and the ball slot C (642) is on the outer wall of the bearing inner ring (64), the ball hole A (621) receives a first ball (6211), and the ball hole B (641) has received a second ball (6411).

2. The control mechanism of a core drilling rig according to claim 1, wherein said fluid channel activation module comprises a lock body (11), a locking rod (12), and a start shear pin (13), the locking rod (12) is in the lock body (11), and the locking rod (12) and the lock body (11) are connected by a start shear pin (13), the central rod (14) is in the locking rod (12), a sealing section A (112) of the lock body (11) and a sealing section B (123) of the locking rod (12) are in a sealing fit, Said sealing section B (123) is in a sealing fit with the central rod (14), a fluid channel A (41) is disposed between the central rod (14) and the locking rod (12), and the locking rod (12) has a connecting fluid channel A (41) and an outflow hole A (1221) on the outer wall, the outflow hole A (1221) is disposed about behind the sealing section B (123), a fluid channel B (42) is disposed between the lock body (11) and the locking rod (12), and the fluid channel B (42) is disposed in the downhole of the sealing section A (112), an outlet of the outflow hole A (1221) is at the sealing section A (112), and a downhole end of the fluid channel A (41) is sealed.

3. The control mechanism of a core drilling rig according to claim 2, wherein said outer barrel unlocking module comprises the connecting pipe (21) and a lock pin (22), the uphole end of the connecting pipe (21) is connected to the lock body (11), the uphole end of the lock pin (22) is connected to the locking rod (12), the central rod (14) passes through the inner cavity of the lock pin (22), and the lock pin (22) is in the connecting pipe (21), the downhole section of the connecting pipe (21) is connected in the outer barrel (23), and the side wall of the downhole section of the connecting pipe (21) has an unlocking hole, a groove A (221) is disposed on the outer wall of the lock pin (22), a groove B (231) is disposed on the inner wall of the outer barrel (23), a pin (24) is arranged in the unlocking hole, the length of the pin (24) is greater than the depth of the unlocking hole, and the outer end of the pin (24) is chamfered and/or the side surface of the groove B (231) is inclined, the width of groove A (221) is not less than the width of the inner end of the pin (24), while the width of the groove B (231) is not less than the width of the outer end of the pin (24), the downhole end of the connecting pipe (21) is in the outer barrel (23), and the pin (24) is in downhole from the groove A (221), the inner end surface of the pin (24) is in a sliding fit with the outer wall of the lock pin (22), and the outer end of the pin (24) is embedded in the groove B (231).

4. The control mechanism of a core drilling rig according to claim 3, wherein said flow diverging module includes a valve housing (31), a lock housing (32) and a trigger mechanism, the central rod (14) passes through the inner cavity of the valve housing (31), the valve housing (31) is disposed inside the lock housing (32), the valve housing (31) includes a sealing section C (311) and a diversion section (312) the lock housing (32) includes an inflow section B (321) and an outflow section B (322), a fluid channel D (44) is disposed between the central rod (14) and the inflow section B (321), a fluid channel E (45) is disposed between the outer wall of the central rod (14) and the inner wall of the valve housing (31), the back end of fluid channel D (44) communicates with fluid channel B (42), and the fluid channel E (45) communicates with the fluid channel D (44), the inner diameter of the inflow section B (322) is longer than the outer diameter of the sealing section C (311), the outer diameter of the sealing section C (311) is longer than the outer diameter of the diversion section (312), and the inner diameter of the outflow section B (322) is equal to the outer diameter of the sealing section C (311), the outflow section B (322) is provided with an outflow hole B (3221), the downhole end of sealing section C (311) is in the inflow section B (321), and the fluid, channel D (44) and the outflow hole B (3221) are connected.

5. The control mechanism of a core drilling rig according to claim 4, wherein said valve housing (31) further includes a locking section A (313), the locking section A (313) is connected to the downhole end of the diversion section (312), the lock housing (32) also includes a locking section B (323), connected to the downhole end of the outflow section B (322), inner wall of the outer barrel (23) is connected to a safety gear (232), the trigger mechanism includes a locking sleeve (33), a fixing ring (35), and the safety gear (232), the lock housing (32) passes through the inner cavity of the locking sleeve (33), and the outer wall of the locking section A (313) is provided with a locking groove A (3131), the locking section B (323) has a locking hole A (3231) and a locking hole B (3232), that are through holes, in both locking hole A (3231) and locking hole B (3232) each receives a, the diameter of the locking ball (34) is longer than the depth of the locking hole A (3231), the locking sleeve (33) includes an impact section (331) and the locking section C (332), the inner wall of the locking section C (332) has a locking groove B (3321) and a locking groove C (3322), the locking groove C (3322) is downhole from the locking groove B (3321), the distance between the locking groove B (3321) and the locking groove C (3322) is equal to the distance between the locking hole A (3231) and the locking hole B (3232), the fixing ring (35) is affixed to the outer wall of the locking section B (323), and the fixing ring (35) is disposed uphole of the locking hole A, the inner diameter of the impact section (331) is longer than the outer diameter of the fixing ring (35) the safety gear (232) includes the clamping part (2321) and the pressing part (2322), the inner diameter of the downhole end of the pressing part (2322) is shorter than the outer diameter of the impact section (331), the inner diameter of the pressing part (2322) is not less than the outer diameter of the fixing ring (35) the inner diameter of the downhole end of the clamping part (2321) is shorter than the outer diameter of the uphole end of the fixing ring (35), a limit part (36) is disposed at the downhole end of the central rod (14), and the limit part (36) is disposed in the locking section B (323) of the lock housing (32), the outer wall of the limit part (36) is provided with a locking groove D (361), a fluid channel F (46) is opened inside the limit part (36) and is connected to the fluid channel E (45) by a hole.

6. The control mechanism of a core drilling rig according to claim 5, wherein a fluid channel C (43) is disposed between the central rod (14), the lock pin (22) and the locking rod (12), the side wall of the locking rod (12) is provided with an inflow hole (1241), the fluid channel B (42) communicates with the fluid channel C (43) through the inflow hole (1241), the fluid channel C (43) communicates with the fluid channel D (44), the connecting pipe (21) includes a pressure-relief section (212) and a choke section (213), the lock pin (22) and the choke section (213) are in a sealing fit, and the inner diameter of the choke section (213) is shorter than the inner diameter of the pressure-relief section (212), the pressure-relief section (212) is provided with a pressure-relief hole (2121) that is a through hole, a shearing plunger (26) in the fluid channel B (42), and the inner diameter of the shearing plunger (26) is longer than the outer diameter of both the lock pin (22) and the locking rod (12), the shearing plunger (26) is connected to the lock body (11) through the end shearing pin (25), the shearing plunger (26) includes a shearing section (261) and a recoil section (262), the outer wall of the shearing section (261) is in a sealing fit with the inner wall of the lock body (11), and the outer diameter of the recoil section (262) is equal to the inner diameter for the downhole part of the pressure-relief hole (2121) in the pressure-relief section (212).

7. The control mechanism of a core drilling rig according to claim 2, characterized in that the outer wall of the locking rod (12) and the inner wall of the lock body (11) are provided with mutually matched limit steps.

8. The control mechanism of a core drilling rig according to claim 2, further comprises a lock nut (15) uphole of the lock body (11), the central rod (14) passes through the inner cavity of the lock nut (15), and the downhole end of the lock nut (15) is threadedly connected with the uphole end of the lock body (11), and the start shear pin (13) passes through the uphole end thread of the lock body (11).

9. The control mechanism of a core drilling rig according to claim 8, wherein the lock nut (15) includes a fixed section (151) and a threaded section (152), the outer diameter uphole of the step of the locking rod (12) is shorter than the inner diameter of the fixed section (151), while the inner diameter of the fixed section (151) is shorter than the outer diameter of the step of the locking rod (12), and the threaded section (152) is connected to the uphole end of the lock body (11).

10. The control mechanism of a core drilling rig according to claim 8, wherein the lock nut (15) is axially provided with a fixing hole A that is a through hole, the lock body (11) has a fixing hole B on the uphole face and the fixing hole B is a blind hole, the fixing hole A and the fixing hole B are paired, the lock nut (15) also includes a fixing screw (16), and the length of the fixing screw (16) is greater than the depth of the fixing hole A, the fixing screw (16) is in the fixing hole A, and the downhole end of the fixing screw (16) is inserted into the fixing hole B through the fixing hole A.

* * * * *